US008006490B2

(12) United States Patent
Kauss

(10) Patent No.: US 8,006,490 B2
(45) Date of Patent: Aug. 30, 2011

(54) HYDRAULIC CONTROL DEVICE

(75) Inventor: Wolfgang Kauss, Francheville (FR)

(73) Assignee: Bosch Rexroth AG, Stuttgart (DE)

( * ) Notice: Subject to any disclaimer, the term of this patent is extended or adjusted under 35 U.S.C. 154(b) by 626 days.

(21) Appl. No.: 12/094,178

(22) PCT Filed: Nov. 10, 2006

(86) PCT No.: PCT/EP2006/010793

§ 371 (c)(1),
(2), (4) Date: Sep. 26, 2008

(87) PCT Pub. No.: WO2007/057126

PCT Pub. Date: May 24, 2007

(65) Prior Publication Data

US 2009/0064673 A1 Mar. 12, 2009

(30) Foreign Application Priority Data

Nov. 21, 2005 (DE) ..... 10 2005 055 309

(51) Int. Cl.
*F15B 11/04* (2006.01)
*F15B 13/00* (2006.01)

(52) U.S. Cl. ..... 60/422; 91/516

(58) Field of Classification Search ..... 60/420, 60/422; 91/516

See application file for complete search history.

(56) References Cited

U.S. PATENT DOCUMENTS 5,752,384 A 5/1998 Schmitt et al.
6,289,675 B1 * 9/2001 Herfs et al. ..... 60/422

FOREIGN PATENT DOCUMENTS

DE 44 17 962 11/1995
DE 197 15 020 10/1998
DE 101 49 791 4/2003
DE 102 45 836 11/2003
WO WO 0102736 A1 * 1/2001
WO 02/42648 5/2002

* cited by examiner

*Primary Examiner* — Thomas E Lazo
(74) *Attorney, Agent, or Firm* — Michael J. Striker

(57) ABSTRACT

A hydraulic control device according to the invention is of load-sensing design and serves to actuate a first hydraulic load and a second hydraulic load. Also provided are a first control valve for actuating the first hydraulic load and a second control valve for actuating the second hydraulic load. A first load signal can be measured on the basis of a load pressure with which the first hydraulic load is acted on, and a second load signal can be measured on the basis of a load pressure with which the second hydraulic load is acted on. Pressure medium from a pressure medium source can be supplied in parallel to the first control valve and to the second control valve. A load signal path can, in order to actuate an adjusting element which is assigned to the pressure medium source, be acted on with a highest presently measured load signal. A limiting device allows the second load signal to be limited to a predefined signal limit value. A switching means can be actuated by means of the second load signal such that, at the latest when the second load signal reaches the signal limit value, the signal conveyed on the load signal path is limited by the limiting device.

7 Claims, 3 Drawing Sheets

HYDRAULIC CONTROL DEVICE

Figure 1:
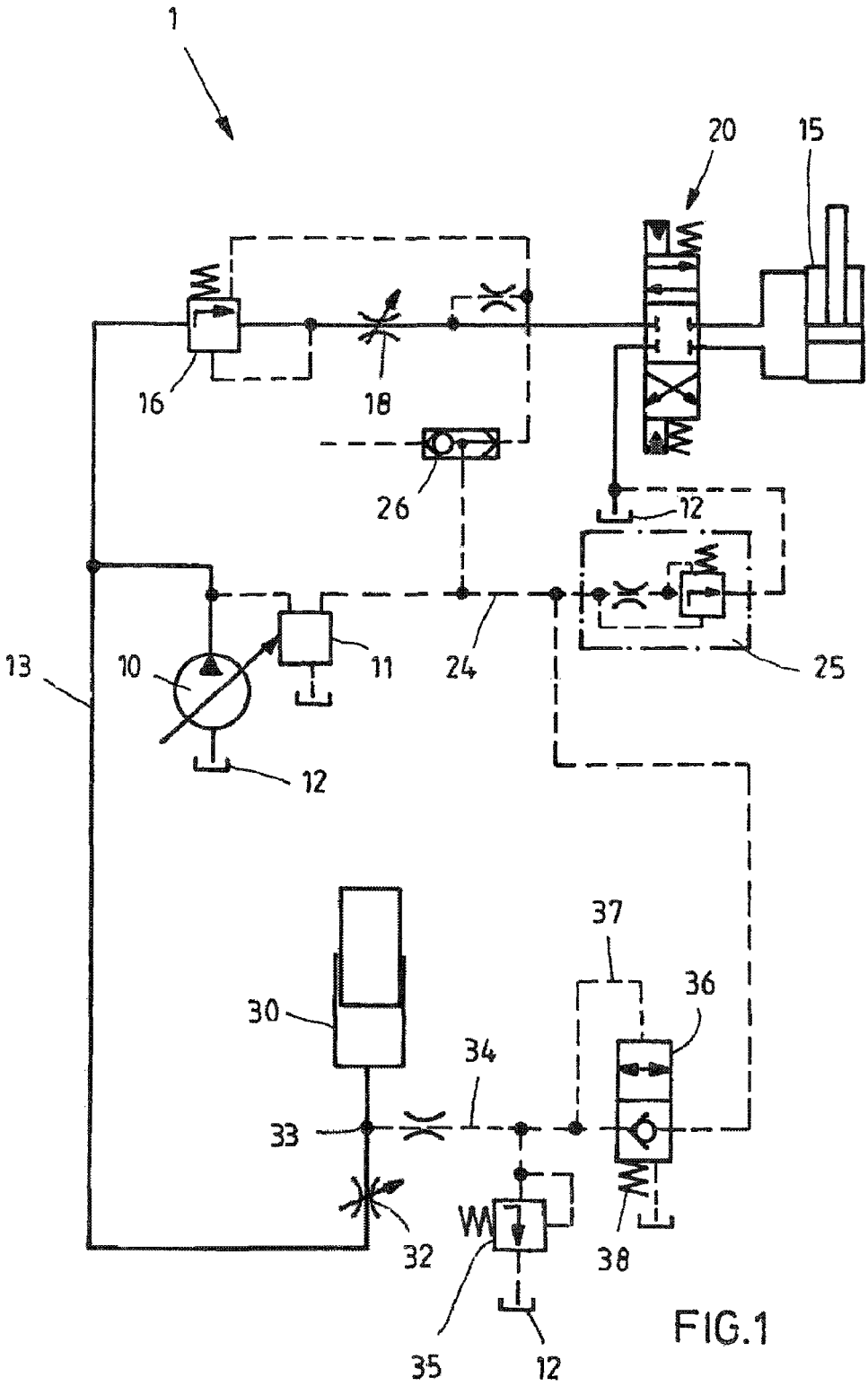

The present invention relates to a hydraulic control device with a load-sensing design, according to the preamble of Claim 1.

A "load-compensated" or "load-sensing" control device for actuating several hydraulic consumers was made known, e.g., in DE 197 15 020 A1 and DE 102 45 838 A1. The load pressure of the individual consumers is ascertained using a control device of this type. The highest detected load pressure is sent via a load-pressure signaling line to a regulating element of the pressure medium source. The pressure supplied by the pressure medium source is therefore adjusted by a certain control-pressure difference Δp above the highest load pressure. The speed of the individual consumers is controlled using adjustable metering orifices. Individual pressure scales regulate the pressure difference via metering valves to a constant value, so that the speed of the individual consumers may be controlled independently of their load pressure. Pressure scales of this type are referred to as LS pressure scales. The consumers that may be actuated in this manner are referred to as LS consumers.

The particular individual pressure scale is typically acted upon in the direction of opening by the load pressure of the consumer, i.e., by the pressure downstream of the metering orifice, and by a control spring, and it is typically acted upon in the closing direction by the pressure upstream of the metering orifice. When the branch of the load-pressure signaling line assigned to the consumer is provided with a pressure-limiting valve, the pressure of the pressure medium supplied to the consumer may be limited individually for each LS consumer. The individual pressure scale then provides, at the most, a pressure at its outlet that corresponds to the opening pressure of the pressure-limiting valve plus the pressure equivalent of its control spring. If one consumer is to be given priority over other consumers, e.g., a steering assembly, then a priority valve is usually provided in place of the individual pressure scale, which controls—in addition to the quantity of pressure medium supplied to the prioritized consumer—the quantity of pressure medium supplied to the subordinate consumers. Pressure may also be limited using a priority valve of this type, in the manner described.

If the intent is to connect a hydromotor—which does not require exact speed control—to a control device of this type, it is desirable for reasons of cost to eliminate an individual pressure scale of this type. An individual pressure scale or a priority valve is not required—at least for regulating quantities—even for consumers whose quantity of pressure medium is not controlled via a metering orifice, e.g., with a steering assembly that is controlled using a rotor set. It is therefore desirable to be able to limit the application of pressure to a consumer in a manner other than via the interaction of a pressure-limiting valve and an individual pressure scale.

Limiting the pressure in a supply line of the consumer directly using a pressure-limiting valve is costly and inefficient, however, due to the size of valve required. This would also result in a constant limitation of pressure for all consumers.

The object of the present invention is to provide an improved hydraulic control device with which the application of pressure on a consumer may be limited in a simple, efficient manner.

This object is attained according to the present invention by a hydraulic control device with the features of claim 1.

The inventive hydraulic control device has a load-sensing design and serves to actuate a first hydraulic consumer and a second hydraulic consumer. The first consumer may be an LS consumer with an individual pressure scale connected upstream or downstream. The case should also be included, however, in which the consumer is an LUDV consumer (lastunabhängige Durchflussverteilung—load-independent flow distribution), as explained in greater detail below. A first control valve for actuating the first hydraulic consumer and a second control valve for actuating the second hydraulic consumer are also provided. A first load signal may be measured on the basis of a load pressure with which the first hydraulic consumer is acted upon, and a second load signal may be measured on the basis of a load pressure with which the second hydraulic load is acted upon. A pressure medium may be supplied from a pressure medium source to the first control valve and the second control valve in parallel. A load signal path may be acted upon to actuate an actuating component assigned to the pressure medium source with the highest currently measured load signal. A limiting device permits the second load signal to be limited to a specified signal limit value.

A special feature of the present invention is the fact that switching means are provided, which may be actuated via the second load signal such that, at the latest when the second load signal reaches the signal limit value, the signal conveyed on the load signal path is limited by the limiting device.

A simple and efficient limiting of the pressure load on the second consumer is attained in this manner. It is therefore possible to operate a less pressure-resistant consumer together with consumers that may receive higher loads in the same hydraulic circuit. In particular, pressure medium may be supplied to the first consumer under a higher pressure than a maximum permissible limit load pressure of the second consumer. The load signal is not limited to the load signal path until the load pressure of the second consumer reaches a specified pressure limit value. In this case, the supply pressure provided by the pressure medium source is reliably lowered in accordance with the pressure limit value and the control pressure difference Δp of the pressure medium source. This limiting of the load signal—which is activated only as needed—on the load signal path therefore permits unlimited operation of the hydraulic consumers under normal operating conditions and reliably protects a consumer when overload is likely to occur. This inventive overload protection may be implemented in control systems that are purely hydraulic and in control systems that are electrohydraulic and load-sensing in design.

Further advantageous embodiments are indicated in the subcdaims.

According to a particularly preferred refinement of the present invention, a switching valve is provided, which, when in an actuated switching setting, fluidly connects a load-pressure signaling line with a pressure-limiting valve. The load pressure of the second consumer is supplied to the switching valve as control pressure. A switching valve of this type may be integrated easily in conventional designs of control of the pressure medium source, and not via a valve that is located in the consumer supply line, as in the conventional case. The valves used according to the present invention to limit pressure, the switching valve, and the pressure-limiting valve are all connected to control lines having small cross sections, and they may therefore be designed cost-favorably in small nominal quantities.

Preferably, the pressure-limiting valve is located on a supply line of a load-pressure signaling connection of the second control valve to the load-pressure signaling line. A configuration of a pressure-limiting valve of this type is already provided in many hydraulic control blocks, and it makes it simple to modify existing model series.

According to a preferred embodiment of the present invention, the switching valve is designed as a poppet valve, and, in an unactuated switching setting, it performs the function of a non-return valve that opens in the direction toward the load-sensing line. In this manner, the switching valve ensures that the load pressure of the second consumer is signaled to the load-pressure signaling line only when it is the consumer with the highest load pressure. The switching valve therefore replaces the non-return valve used in conventional designs for this purpose and makes possible a compact and efficient design of the control device.

A switching pressure required to actuate the switching valve preferably corresponds, at the most, to the opening pressure of the pressure-limiting valve. As a result, when the second consumer is at risk of overload, the pressure in the load-signaling line is securely limited to the opening pressure of the pressure-limiting valve.

When the switching pressure of the switching valve is lower than the opening pressure of the pressure-limiting valve by approximately 5 to 10 bar, then pressure limitation is implemented in a particularly reliable manner.

The first control valve preferably includes a load-holding valve. It is therefore ensured that the first consumer is secured against failing, regardless of a pressure limitation in the load-signaling line and a supply pressure that has been therefore reduced.

The present invention and its advantages are described in greater detail below with reference to the exemplary embodiment presented in the figures.

Figure 2:
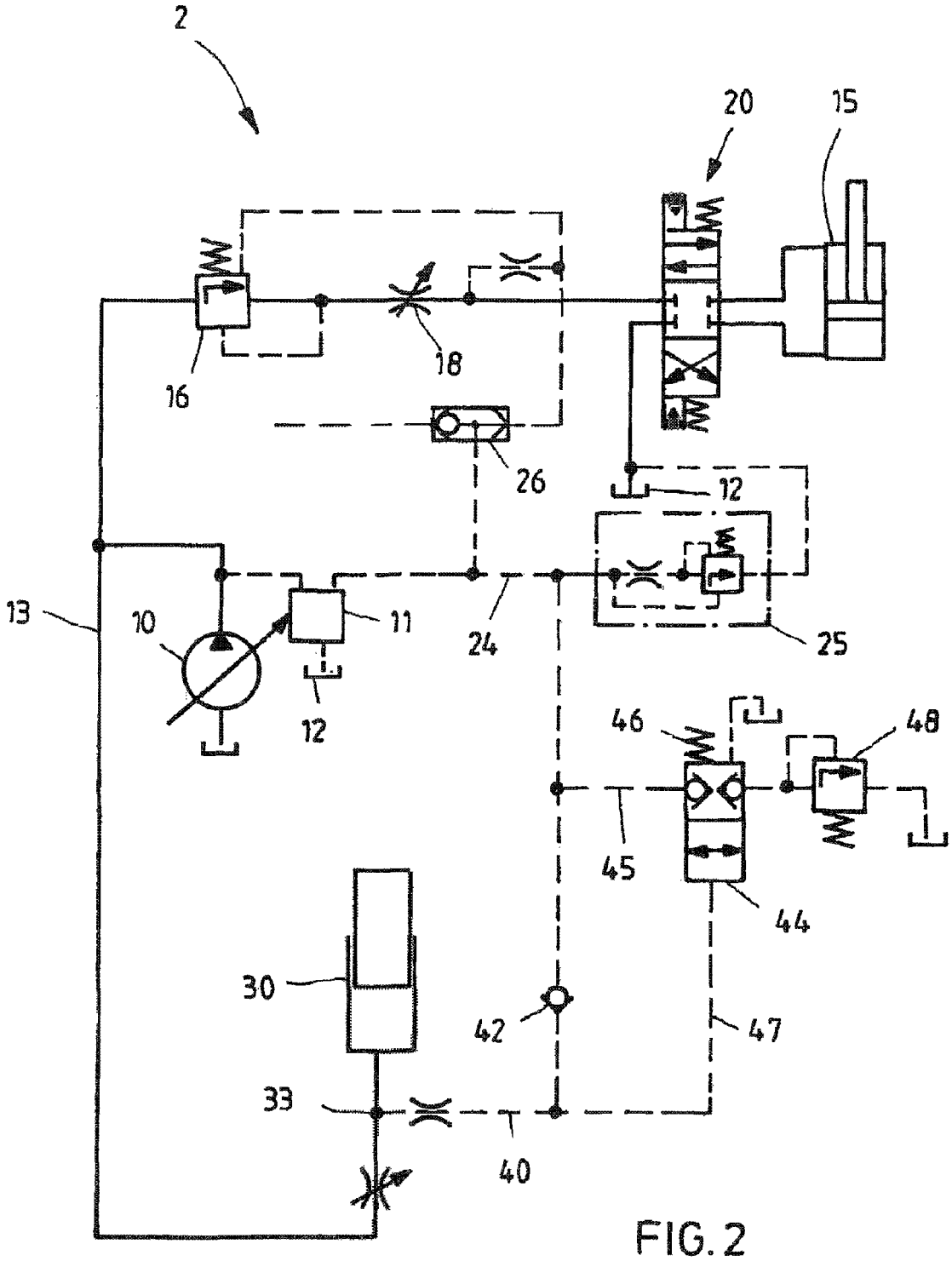
Figure 3:
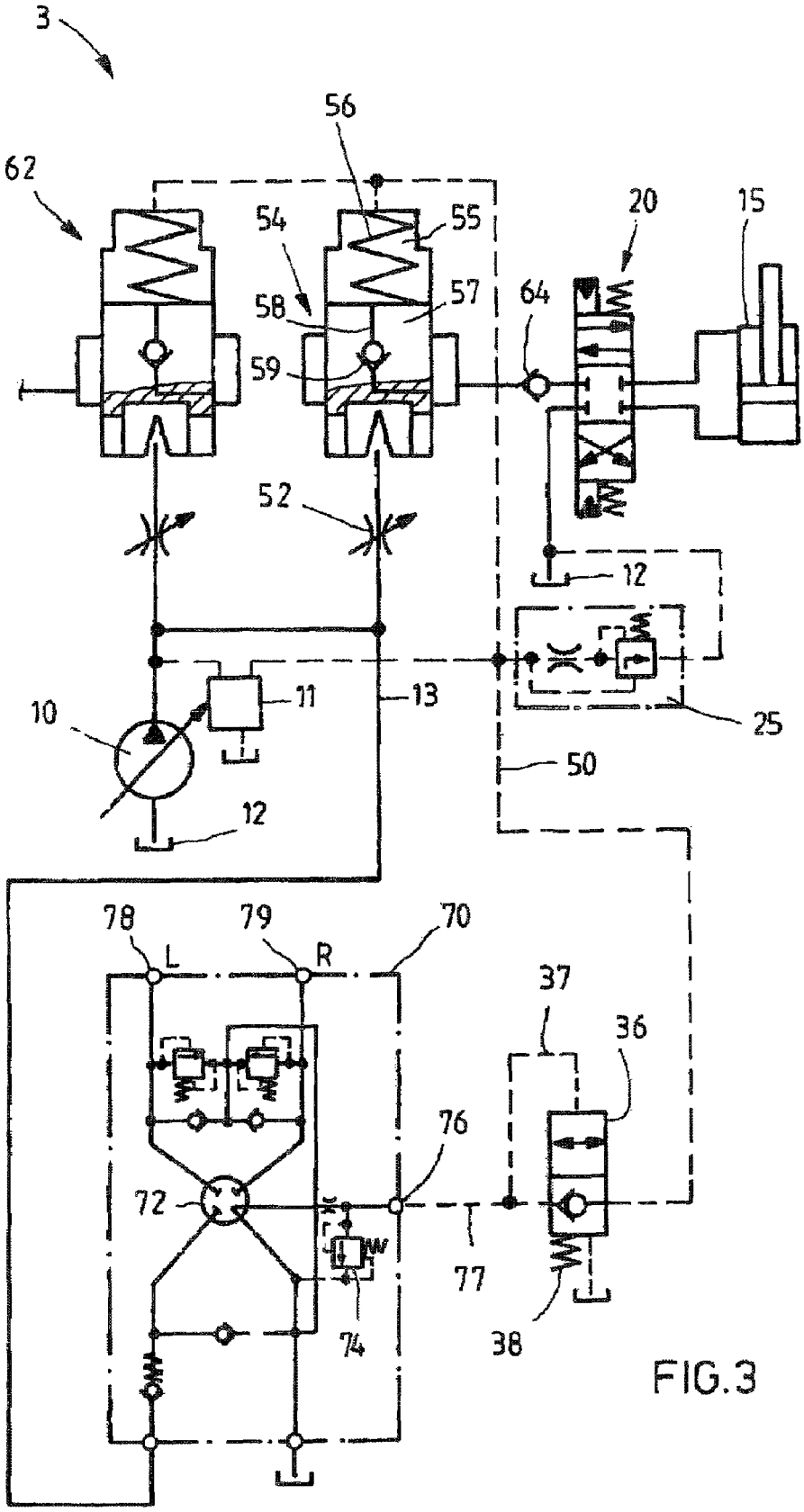

FIG. 1 shows a circuit diagram of a hydraulic control system for a consumer in whose supply line an individual pressure scale is located, and for a further consumer, whose load pressure signal is used to actuate a switching valve that controls a connection between a pressure-limiting valve that limits the load pressure of the further consumer and a load-pressure signaling line, FIG. 2 shows a modification of the circuit presented in FIG. 1, with an alternative arrangement of a switching valve and the pressure-limiting valve, with which the pressure-limiting valve is not connected directly to a load-signaling connection of the first consumer, and FIG. 3 shows a modification of the circuit presented in FIG. 1, according to which several consumers are actuatable in the sense of an LUDV control, and according to which a steering assembly is provided, as a further consumer, with whose load-pressure signal the switching valve is actuated.

According to FIG. 1, a hydraulic control device 1 serves to actuate at least two hydraulic consumers 15 and 30. A pressure medium supply line 13 is supplied with pressure medium from a supply tank 12 via a hydropump 10. Hydropump 10 is a variable-capacity pump, the pump capacity of which is controlled using a pump regulator 11. Pump regulator 11 is controlled via the pressure signal present in a load-pressure signaling line 24. It ensures that a pressure occurs at the outlet of pump 10 that is above the load pressure signal by a certain regulating pressure Δp.

Hydraulic consumer 15 is actuated via an individual pressure scale 16, an adjustable metering orifice 18, and a directional control valve 20. Typically, adjustable metering orifice 18 and directional control valve 20 are both formed on the valve piston of a control valve. Pressure scale 16 is acted upon in the opening direction with the pressure downstream of adjustable metering orifice 18, and with the force of a control spring. In the closing direction, the pressure upstream of metering orifice 18 is present at the control element of pressure scale 16. The pressure measured downstream of metering orifice 18 corresponds to the load pressure of consumer 15. This load pressure is supplied as a pressure signal via a shuttle valve 26 to load-pressure signaling line 24. Shuttle valve 26 makes it possible to also direct load-pressure signals from further consumers to load-pressure signaling line 24, which is acted upon with the highest load-pressure signal that was measured. Control line 24 may be relieved toward supply tank 12 via a flow-control valve 25.

Hydraulic consumer 30 is essentially actuated via an adjustable metering orifice 32. It may be designed together with a directional control valve on the valve piston of a further control valve. A load pressure signal of consumer 30 may be measured at a load-pressure signaling connection 33. Load-pressure signaling connection 33 is typically located on the control valve, which is also adjustable metering orifice 32. Load-pressure signaling connection 33 is connected with a control line 34. The pressure at control line 34 is limited by a pressure-limiting valve 35. Control line 34 leads to a switching valve 36. A control element of switching valve 36 is acted upon by a spring 38 in the direction of an unactuated valve setting. In the direction of an actuated valve setting, switching valve 36 is acted upon by the load pressure signal from consumer 30, which is sent from control line 34 via a further control line 37. Switching valve 36 controls a connection between control line 34 and load-pressure signaling line 24. In the unactuated switching setting, switching valve 26 performs the function of a non-return valve that opens toward load-pressure signaling line 24. In the actuated switching setting, switching valve 36 opens a fluid connection between control line 34 and load-pressure signaling line 24.

The actuation of hydraulic consumer 15 corresponds to the conventional actuation of a consumer in a load-sensing system and will therefore not be explained here. The discussion below focuses on the mechanism of the limitation of the load pressure that acts on consumer 30. The opening pressure of pressure-limiting valve 35 corresponds to a pressure that is below the maximum permissible load pressure of consumer 30 by the control pressure difference Δp of pump regulator 11. Spring 38 of switching valve 36 is dimensioned such that it corresponds to a switching pressure that is below the opening pressure of pressure-limiting valve 24 by approximately 5 to 10 bar.

Switching valve 36 remains closed for as long as the load pressure of consumer 30 is below the switching pressure of switching valve 36. In this state, either the load pressure of consumer 15 is signaled in load-pressure signaling line 24, or the load pressure of consumer 30 is signaled via the non-return valve function of switching valve 36, depending on which load pressure is higher. The load pressure signal signaled in loud-pressure signaling line 24 by consumer 15 or by further consumers may be far above the maximum permissible load pressure of consumer 30. Accordingly, the supply pressure that is also supplied by hydropump 10 may also exceed the maximum permissible load pressure of consumer 30. Consumer 30 is not overloaded, however, provided that consumer 30 is acted upon with a load that results in a load pressure below its maximum permissible load pressure.

As soon as the load pressure signal of consumer 30 exceeds the switching pressure of switching valve 36, switching valve 36 releases a connection between load-pressure signaling line 24 and control line 34, and pressure-limiting valve 35 in particular. As a result, the load pressure signal present in load-pressure signaling line 24 is limited to the opening pressure of pressure-limiting valve 35. Since the switching pressure of switching valve 36 is lower than the opening pressure of pressure-limiting valve 35 by approximately 5 to 10 bar, and the opening pressure is lower than the maximum permissible load pressure of consumer 30 by approximately the control pressure difference Δp of pump regulator 11, consumer 30 is effectively safeguarded against overload in this manner.

When switching valve 36 is actuated, the load pressure signal on central load pressure signaling line 24 and, therefore, the supply pressure provided to all consumers is limited. This only happens, however, when consumer 30 is at risk of overload. During normal operation, consumer 15 and further consumers may be operated with a pressure that is above the load pressure limit of consumer 30.

FIG. 2 is a circuit diagram of a hydraulic control device 2. Hydraulic control device 2 is a modification of hydraulic control device 1, and it differs from hydraulic control device 1 only in terms of the location of the switching valve and the pressure-limiting valve, and in the type of switching valve that is installed. Components of hydraulic control device 2 that correspond to those of hydraulic control device 1 are labeled with the same reference numerals and will not be described separately. In contrast to hydraulic control device 1, with hydraulic control device 2, switching valve 44 is fluidly connected with load-pressure signaling line 24 via a separate connecting line 45. Pressure-limiting valve 48 is located downstream of switching valve 44. A control line 40 extends from load-pressure signaling connection 33 of consumer 30 or a control valve via a non-return valve 42 that opens toward load-pressure signaling line 24, to load-pressure signaling line 24. The load pressure signal of consumer 30 is sent via control line 47 to an actuating component of switching valve 44 and acts on it in the opening direction. In the closing direction, the actuating component of switching valve 44 is acted upon by spring 48. In an actuated switching position of switching valve 44, there is a fluid connection between load-pressure signaling line 24 and pressure-limiting valve 48. In an unactuated switching position of switching valve 44, the fluid connection between load-pressure signaling line 24 and pressure-limiting valve 48 is interrupted.

As with hydraulic control device 1, the opening pressure of pressure-limiting valve 48 is adjusted in accordance with the maximum permissible load pressure of consumer 30. The switching pressure of switching valve 44, which is determined by spring 46, is approximately 5 to 10 bar less than the opening pressure of pressure-limiting valve 48.

Provided that a higher load pressure does not exist at any of the other consumers, the load pressure measured at load-pressure signaling line 33 is signaled via non-return valve 42 into load-pressure signaling line 24. In addition, the load pressure measured at connection 33 is applied to switching valve 44 via control line 47. When this load pressure signal reaches the opening pressure of switching valve 44, switching valve 44 releases the connection between load-pressure signaling line 24 and pressure-limiting valve 48. As a result, the load pressure signal conveyed on load-pressure signaling line 24 is limited to the opening pressure of pressure-limiting valve 48. The function of hydraulic control device 2 therefore conforms with the function of hydraulic control device 1 in terms of the overload protection of consumer 30. The fact that switching valve 44 is connected to load-pressure signaling line 24 via a separate control line 45 allows for greater flexibility in terms of locating switching valve 44 and pressure-limiting valve 48. In addition, a switching valve with a simple design may be used.

Hydraulic control device 3 shown in FIG. 3 is a further modification of hydraulic control device 1 shown in FIG. 1. Again, the same components are labeled with the same reference numerals, and they will not be described separately. The speed of consumer 15 is controlled using a metering orifice 52. A pressure scale 54 is located downstream of metering orifice 52. A load-holding valve 64 and directional control valve 20 are located in the fluid-flow path from pump 10 to consumer 15. Pressure scale 54 includes a control piston 57. Via control piston 57, a control line 58 leads into a rear chamber 55 of pressure scale 54. A non-return valve 59 that opens toward rear chamber 55 is located in control line 58. Rear chamber 55 is fluidly connected with a load-pressure signaling line 50. A spring 56 is located in rear chamber 55, which acts on control piston 57. Further consumers (not shown) are supplied with pressure medium via pressure scales 62 of the same design.

A steering assembly 70 is supplied via line 13. Steering assembly 70 actuates the steering cylinder of a motor vehicle via connections 78 and 79. The main component of steering assembly 70 is a rotor set 72, via which the quantity of pressure medium supplied to connections 78 and 79 is controlled. A load pressure signal is directed outwardly at a load-pressure signaling connection 76 of steering assembly 70. This load pressure signal is limited within steering assembly 70 by a pressure-limiting valve 74. The load pressure signal present at load-pressure signaling connection 76 is sent to switching valve 36 via control line 77. An actuating component of switching valve 36 is acted upon with this load pressure signal via control line 37.

Pressure scale 54 regulates the pressure downstream of metering orifice 52 to a value that is higher than the load pressure signal by the pressure equivalent of the force of spring 56 that exists in its rear chamber 55. Spring 56 is typically very weak in design, so that the pressure between metering orifice 52 and pressure scale 54 is only slightly higher than the load pressure signal present in pressure chamber 55. This load pressure signal corresponds to the highest load pressure of the connected consumer. As is pressure chamber 55, the rear chambers of further pressure scales 62, etc., are also acted upon with the load pressure signal that is conveyed in load-pressure signaling line 50. The pressure upstream of metering orifice 52 corresponds to the supply pressure provided by hydropump 10. A pressure differential therefore exists at metering orifice 52, which essentially corresponds to control pressure difference Δp of pump regulator 11. This type of load-sensing control is referred to as load-independent flow distribution (LUDV). If the volumetric flow rate conveyed by the pump is not sufficient to cover the demand of the consumers, the available flow distributes itself evenly among all of the consumers that are actuated in this manner.

Steering assembly 70, as a further consumer, is supplied by pump 10 via supply line 13. Via the dimensioning of pump 10, an exact calculation of the demand of other consumers 15, etc., and/or via a suitable control of the load pressure conditions that occur at the consumers during operation, it is ensured that undersaturation does not occur, and that steering assembly 70 is always supplied with a sufficient quantity of pressure medium. The load pressure signal present at outlet 76 of steering assembly 70 is sent to load-pressure signaling line 50 via switching valve 36, which performs the function of a non-return valve when in the unactuated position. As soon as the load pressure of steering assembly 70 approaches a maximum permissible load pressure, and, therefore, steering assembly 70 is at risk of overload, switching valve 36 is switched into an actuated position via the load pressure signaled by steering assembly 70, in which actuated position switching valve 36 fluidly connects load-pressure signaling line 50 and load-pressure signaling connection 76. As a result, the pressure in load-pressure signaling line 50 is limited by internal pressure-limiting valve 74 of steering assembly 70. Steering assembly 70 is therefore reliably prevented from becoming overloaded. As long as switching valve 36 is not actuated, the load pressure signal in load-pressure signaling line 50 may be far above the maximum inadvertent load pressure of steering assembly 70. The load pressure signal in central load-pressure signaling line 50 is limited only when steering assembly 70 is at risk of overload, i.e., when its load pressure reaches the switching pressure of switching valve 38. Load-holding valve 64 is located in the supply line of consumer 15 in order to prevent a possible failure of consumer 15 due to the limitation of the load pressure and the resultant limitation of the supply pressure.

Finally, it should be noted that overload-protection mechanisms described with reference to hydraulic control devices 1, 2, and 3 may also be implemented in the electronic control unit of an electrohydraulic control device. With reference to a hydraulic control device, the load-signaling path as described in Claim 1 is implemented as a load-pressure signaling line, the limiting device is implemented as a pressure-limiting valve, and the switching means are implemented as a switching valve.

LIST OF REFERENCE NUMERALS

1 Hydraulic control device
2 Hydraulic control device
3 Hydraulic control device
10 Pump
11 Pump regulator
12 Tank
13 Supply line
15 Hydraulic consumer
16 Pressure scale
18 Adjustable metering orifice
20 Directional control valve
24 Load-pressure signaling line
25 Flow-regulating valve
26 Shuttle valve
30 Hydraulic consumer
32 Adjustable metering orifice
33 Load-pressure signaling connection
34 Control line
35 Pressure-limiting valve
36 Switching valve
37 Control line
38 Spring
40 Control line
42 Non-return valve
44 Switching valve
45 Connecting line
46 Spring
48 Pressure-limiting valve
50 Load-pressure signaling line
52 Metering orifice
54 Pressure scale
55 Rear pressure chamber
56 Control spring
57 Regulating piston
58 Control line
59 Non-return valve
62 Pressure scale
64 Load-holding valve
70 Steering assembly
72 Rotor set
74 Pressure-limiting valve
76 Load-pressure signaling connection
77 Control line
78 Connection
79 Connection

What is claimed is:

1. A hydraulic control device with a load-sensing design for actuating a first hydraulic consumer (15) and a second hydraulic consumer (30), with which a first control valve (18, 20) for actuating the first hydraulic consumer (15) and a second control valve (32) for actuating the second hydraulic consumer (30) are provided, a first load signal may be measured on the basis of a load pressure with which the first hydraulic consumer (15) is acted upon, and a second load signal may be measured on the basis of a load pressure with which the second hydraulic consumer (30) is acted upon; pressure medium from a pressure medium source (10) may be supplied in parallel to the first control valve (18, 20) and to the second control valve (32), a load signal path (24) is provided, which may be acted upon with a highest currently measured load signal in order to actuate an actuating component (11) assigned to the pressure medium source (10), and with which a limiting device (35; 48) is provided, which allows the second load signal to be limited to a predefined signal limit value, wherein switching means (36; 44) are provided that may be actuated by means of the second load signal such that, at the latest when the second load signal reaches the signal limit value, the signal conveyed on the load signal path (24) is limited by the limiting device (35; 48).

2. The hydraulic control device as recited in claim 1, wherein a switching valve (36; 44) is provided that, when in an actuated switching position, fluidly connects a load-pressure signaling line (24) with a pressure-limiting valve (35; 48), and wherein the load pressure of the second consumer (30) is directed to the switching valve (36; 44), as a control pressure.

3. The hydraulic control device as recited in claim 2, wherein the pressure-limiting valve (35; 74) is located on a supply line from a load-pressure signaling connection of the second control valve (32; 72) to the load-pressure signaling line (24; 50).

4. The hydraulic control device as recited in claim 3, wherein the switching valve (38) is designed as a poppet valve, and, in an unactuated switching setting, it performs the function of a non-return valve that opens in the direction toward the load-pressure signaling line (24; 50).

5. The hydraulic control device as recited in claim 2, wherein a switching pressure required to actuate the switching valve (36; 44) corresponds, at the most, to the opening pressure of the pressure-limiting valve (35; 48; 74).

6. The hydraulic control device as recited in claim 5, wherein the switching pressure of the switching valve (36; 44) is 5 to 10 bar below the opening pressure of the pressure-limiting valve (35; 48; 74).

7. The hydraulic control device as recited in claim 1, wherein the first control valve (52, 20, 64) includes a load-holding valve.

* * * * *